US011636832B2

(12) United States Patent
Singh

(10) Patent No.: US 11,636,832 B2
(45) Date of Patent: Apr. 25, 2023

(54) MODULAR AND CUSTOMIZABLE GUITAR CONSTRUCTION

(71) Applicant: Sudipta Singh, Shrewsbury, MA (US)

(72) Inventor: Sudipta Singh, Shrewsbury, MA (US)

(73) Assignee: Talent on Tap, LLC, Shrewsbury, MA (US)

( * ) Notice: Subject to any disclaimer, the term of this patent is extended or adjusted under 35 U.S.C. 154(b) by 44 days.

(21) Appl. No.: 17/304,210

(22) Filed: Jun. 16, 2021

(65) Prior Publication Data

US 2021/0390930 A1 Dec. 16, 2021

Related U.S. Application Data

(60) Provisional application No. 63/039,554, filed on Jun. 16, 2020.

(51) Int. Cl.

| | |
|---|---|
| ***G10D 3/06*** | (2020.01) |
| ***G10D 3/12*** | (2020.01) |
| ***G10D 3/14*** | (2020.01) |
| ***G10D 1/08*** | (2006.01) |

(52) U.S. Cl.

CPC ..... *G10D 3/12* (2013.01); *G10D 1/08* (2013.01); *G10D 3/06* (2013.01); *G10D 3/14* (2013.01)

(58) Field of Classification Search

CPC .. G10D 3/12; G10D 1/08; G10D 3/06; G10D 3/14

See application file for complete search history.

(56) References Cited

U.S. PATENT DOCUMENTS

| | | | |
|---|---|---|---|
| 4,852,450 | A | 8/1989 | Novak |
| 5,347,904 | A | 9/1994 | Lawrence |
| 5,631,432 | A | 5/1997 | Muncy |
| 5,637,823 | A | 6/1997 | Dodge |
| 5,949,005 | A | 9/1999 | Peterson |
| 5,994,633 | A | 11/1999 | Norton |
| 6,046,393 | A | 4/2000 | Rose |
| 6,253,654 | B1 | 7/2001 | Mercurio |
| 6,911,590 | B2 | 6/2005 | Childress |
| 7,002,065 | B2 | 2/2006 | Petersen |
| 7,256,343 | B2 | 8/2007 | Brubaker et al. |
| 7,375,267 | B2 | 5/2008 | Poschelk |
| 7,417,185 | B2 | 8/2008 | Ludwig |
| 7,442,865 | B2 | 10/2008 | Moghaddam |
| 9,378,711 | B1 | 6/2016 | Stadnyk |
| 9,454,947 | B1 | 9/2016 | Hart et al. |

(Continued)

OTHER PUBLICATIONS

Gary Magliari. (2006). Method for Positioning Musical Instrument Frets That Compensate for Fretting-Induced String Tension. Gary Magliari.

*Primary Examiner* — Kimberly R Lockett
(74) *Attorney, Agent, or Firm* — Dunlap Bennett & Ludwig, PLLC

(57) ABSTRACT

A modular and customizable construction for a guitar is disclosed. The construction may include a substantially flat metal guitar base plate that couples to interchangeable guitar components, such as a guitar body, a fretboard, and guitar string tuners. Further provided is a moveable nut that is used to adjust guitar string scale length via nut blocks that are separately adjustable relative to one another. Even further provided is a computer program product that allows for development of custom fingerboards that cater to a specific player's requirements and are optimized for alternative tunings and temperaments.

3 Claims, 4 Drawing Sheets

(56) References Cited

U.S. PATENT DOCUMENTS

| | | | |
|---|---|---|---|
| 9,881,593 | B2 | 1/2018 | Edwards |
| 10,311,851 | B1 | 6/2019 | Stadnyk |
| 10,475,420 | B1 | 11/2019 | Stadnyk |
| 10,540,946 | B2 | 1/2020 | Reddick |
| 10,643,584 | B1 | 5/2020 | Kudirka |
| 2004/0237752 | A1 | 12/2004 | Pye |
| 2012/0011984 | A1 | 1/2012 | Atijas |
| 2015/0059560 | A1 | 3/2015 | Perea Torres |

MODULAR AND CUSTOMIZABLE GUITAR CONSTRUCTION

CROSS-REFERENCE TO RELATED APPLICATION

This application claims the benefit of priority of U.S. provisional application No. 63/039,554, filed Jun. 16, 2020, the contents of which are herein incorporated by reference.

BACKGROUND OF THE INVENTION

The present invention relates to electric guitar construction and, more particularly, includes a method of electric guitar construction using modular and interchangeable components that can be replaced and customized by an average user with minimal tools. The method of construction, and components employed allow for an instrument that plays accurate pitches with a great degree of precision, as well as offering the player the ability to customize the pitches generated, to their desire, such as selecting alternative tunings and temperaments, customizing the sounds generated to the playing style of the individual artist, the selection of hardware components, and the overall look and feel of the instrument.

Stringed instruments in general, and the guitar, generate notes of particular pitches by implementing a fingerboard in which are embedded frets, placed at intervals mathematically computed to generate a note of the desired pitch, when a player presses down a string at that fret location, and strikes the string with the other hand or a plectrum.

The note generated by the player in this fashion, may deviate from the pitch desired to sound, due to several factors. Assuming that the fret for that note pitch is located at the correct mathematically computed position on the fingerboard, the height of the string above the fret at that location (referred to as "string action"), the curvature of the neck of the guitar under string tension ("neck straightness"), the degree and strength with which the player presses down on the string, string gauge/thickness, overall length of the un-plucked string ("scale length"), relative position of the bridge and nut as related to the fret being played—all contribute to variability in the actual pitch generated by the instrument from the ideal note that should sound in that position.

To address some of these factors, "Intonation"—a process of adjusting the position of the bridge relative to the $12^{th}$ fret and open string (0 fret), is commonly employed, to evenly distribute/compensate for pitch errors encountered between notes played on the lower frets (below the $12^{th}$ fret) and notes played higher up the neck of the guitar.

To be able to play accurately with electronic instruments like synthesizers and keyboards, the pitches on the guitar correspond with a specific division of the octave into twelve divisions, called "Even Temperament". While this allows the instrument to be tuned to play music in all twelve keys with equal facility, the physics of stringed instruments, and the fixed placement of frets, nut and bridge relative to the fingerboard, restrict the guitar from playing perfectly in tune in any and every key. Currently, only fret-less instruments can accurately be played, with "Just Intonation" in every key, based on the skill of the player, and his/her ear in placing his/her fingers at the right location on the fingerboard.

Players desiring a more accurate representation of a particular key ("Just Intonation") or a temperament other than "Even Temperament" need to have custom instruments developed for them, with fretboards that are designed to play pitches corresponding to those temperaments. At a minimum, this requires the player to replace the "neck" of the guitar (which contains the fingerboard) with a neck and fretboard that is specifically designed for that temperament, a task that is typically out of the expertise level of an average beginner or an intermediate level player and requires a luthier to make those changes.

The pitch stability (or tuning stability) of the instrument is also affected by the type and precision of tuning machines installed on the guitar, the presence or absence of fine-tuning adjusters on the bridge, and/or locking nuts and locking tuners—which are designed to "lock in" the desired string tension for that particular guitar string and its gauge/thickness once set. This is important to ensure that once tuned, the instrument retains the tuning that has been "locked in", and pitches do not drift over time. The nature of wood instruments, like the guitar, is that they are very susceptible to temperature and humidity changes, and therefore, even a well-tuned instrument will drift in pitch when exposed to these changes and will need to be re-tuned.

Apart from pitch, the timbre of the sound generated is also a function of the material with which the guitar body is constructed, the nature of the pickups installed to pick up the vibrations from the strings, and the controls on the guitar that allow the player to select various pickup combinations, and tone/volume settings for their performance. These elements are often replaced and customized by individual players looking to achieve a particular sound.

One last element of customization for playability, unrelated to pitch, has to do with the profile or shape of the neck behind the fingerboard, and the width and cross-sectional profile of the fingerboard itself. There is a wide variety of shapes and profiles catering to different players preferences and comfort, typically, these cannot be customized or changed for a particular instrument without wholesale replacement of the neck/fingerboard combination.

Tuning, keeping a guitar in tune, customizing the sounds generated, and being able to customize the components—neck, pickups, body material, style, color, finger board width, neck profile, action, neck straightness, tuning machines—is key to having an instrument that is matched perfectly to a given players preferences, and playing style.

As can be seen, there is a need for a guitar design and construction as detailed herein.

SUMMARY OF THE INVENTION

The present invention envisages a metal core to which are bolted on, the body, the underside of the neck, the fingerboard, a bridge with fine tuners for each string, locking tuners, and a novel locking nut which allows customized bridge and nut adjustments for each string.

The invention also implements a method for developing custom fretboards for a player, that are designed to match his/her preferences for string gauge, action, finger pressure, and desired temperament. The player can choose to purchase multiple fingerboards and install/swap them in and out of the instrument without luthier tools.

A mathematical algorithm (and associated process) and computer program product are employed to create fingerboards that are already adjusted to deliver more accurate pitches than are conventionally available, by leveraging the present invention's ability to adjust both ends of the instrument (bridge, and nut) for each string, and mathematically computing optimal positions for the frets that take into account string gauge, desired action, generic pitch deviations caused by the player pressing down on the strings. This algorithm (and associated process) and computer program product can be used to develop player-specific fingerboards based on performance data supplied by the player for an even more accurately playing instrument.

Additional customization capabilities are the ability to exchange the underside of the neck to a profile and material/finish that is desired by the player, replace pickups, and tone controls, and usetuners and bridges of their desire.

The present invention may further include an onboard computer to store and play backing tracks along with the instrument, as well as generate sounds from different types of pickups (e.g., piezo, MIDI, etc.) installed on the guitar and blend them with the traditional electric guitar style pickup sounds. This onboard computer can be remotely accessed over various networks, such as but not limited to LAN/Wi-fi/USB/BLUETOOTH™, to upload songs, tones and timbres, which can be accessed by the player to generate a wider array of sounds from the instrument, as well as provide for solo-accompaniment—useful for solo performances or practice.

In general, embodiments of the present invention include a design and architecture for guitar construction comprising: (1) a metal core, with holes drilled and tapped to accept conventional screws to anchor guitar components to a geometrically flat base. The components include but are not limited to, commercially available or custom designed bodies, bridges, tuners, pickups, neck profiles, custom fingerboards, custom locking nut, and audio and computer electronics; (2) a custom locking nut which allows for precise scale length adjustments on a per string basis, intended to be used with commercially available guitar bridges that offer fine tuning, and length adjustments on a per-string basis; (3) custom designed finger/fret boards, constructed so as to be able to be bolted on to the metal core with commercially available fasteners; (4) custom designed fret placements on the fingerboard, that are optimized for accurate pitches in standard/even temperament, and standard string gauge and action settings; and (5) a computer program product that allows for development of custom fingerboards that cater to a specific player's requirements, and are optimized for alternative tunings and temperaments. Further, the present invention includes guitars produced per the design and architectures listed above and comprising metal cores of different shapes, different body materials and shapes, different bridge types, pickup types, fingerboard types, tuner types, neck profiles, fingerboard profiles, custom fret placements, and utilizing the custom locking nut as mentioned above, and described in greater detail below.

These and other features, aspects and advantages of the present invention will become better understood with reference to the following drawings, description and claims.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
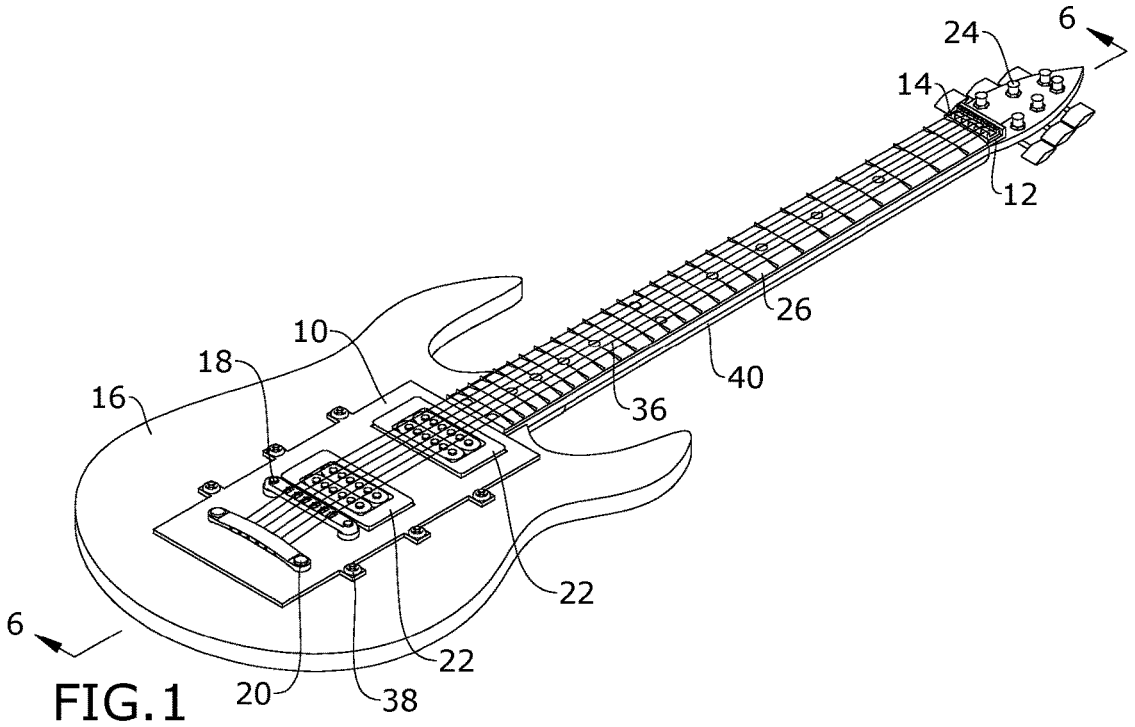
FIG. 1 is a perspective view of an embodiment of the present invention.
Figure 2:
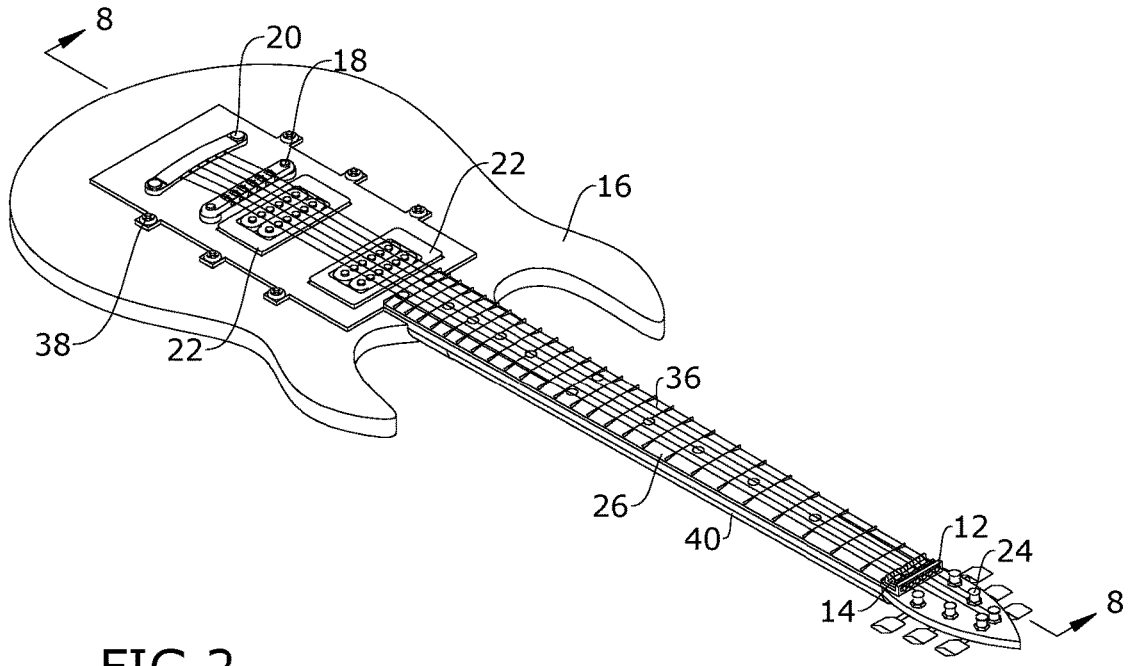
FIG. 2 is another perspective view of the embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The terminology used herein is for the purpose of describing particular embodiments only and is not intended to be limiting of the invention. As used herein, the term, "and/or" includes any and all combinations of the listed items. As used herein, the singular forms "a", "an" and "the" are intended to include the plural forms as well as the singular forms, unless the context clearly indicates otherwise. It will be further understood that the terms "comprises" and/or "comprising", when used in this specification, specify the presence of stated features, steps, operations, elements, and/or components but do not preclude the addition of one or more other features, steps, operations, elements, components, and/or groups thereof.

Unless otherwise defined, all terms (including technical and scientific) used herein have the same meaning commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit, and each can also be used in conjunction with one or more, or in some cases, all, of the other disclosed techniques. Accordingly, for the sake of clarity, this description will refrain from repeating every possible combination of the individual steps in an unnecessary fashion. Nevertheless, the specification should be read with the understanding that such combinations are entirely within the scope of the invention and the claims.

The terms "proximal" and "distal" are defined herein relative to the guitar body 16 and bridge 18. The term "proximal" refers to the position of an element closer to the body 16/bridge 18 and the term "distal" refers to the position of an element further away from the body 16/bridge 18. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

Broadly, one embodiment of the present invention is a modular and customizable construction for a guitar. The construction may include a substantially flat metal guitar base plate that couples to interchangeable guitar components, such as a guitar body, a fretboard, and guitar string tuners. The construction further includes a moveable nut that is used to adjust guitar string scale length via nut blocks that are separately adjustable relative to one another.

Figure 3:
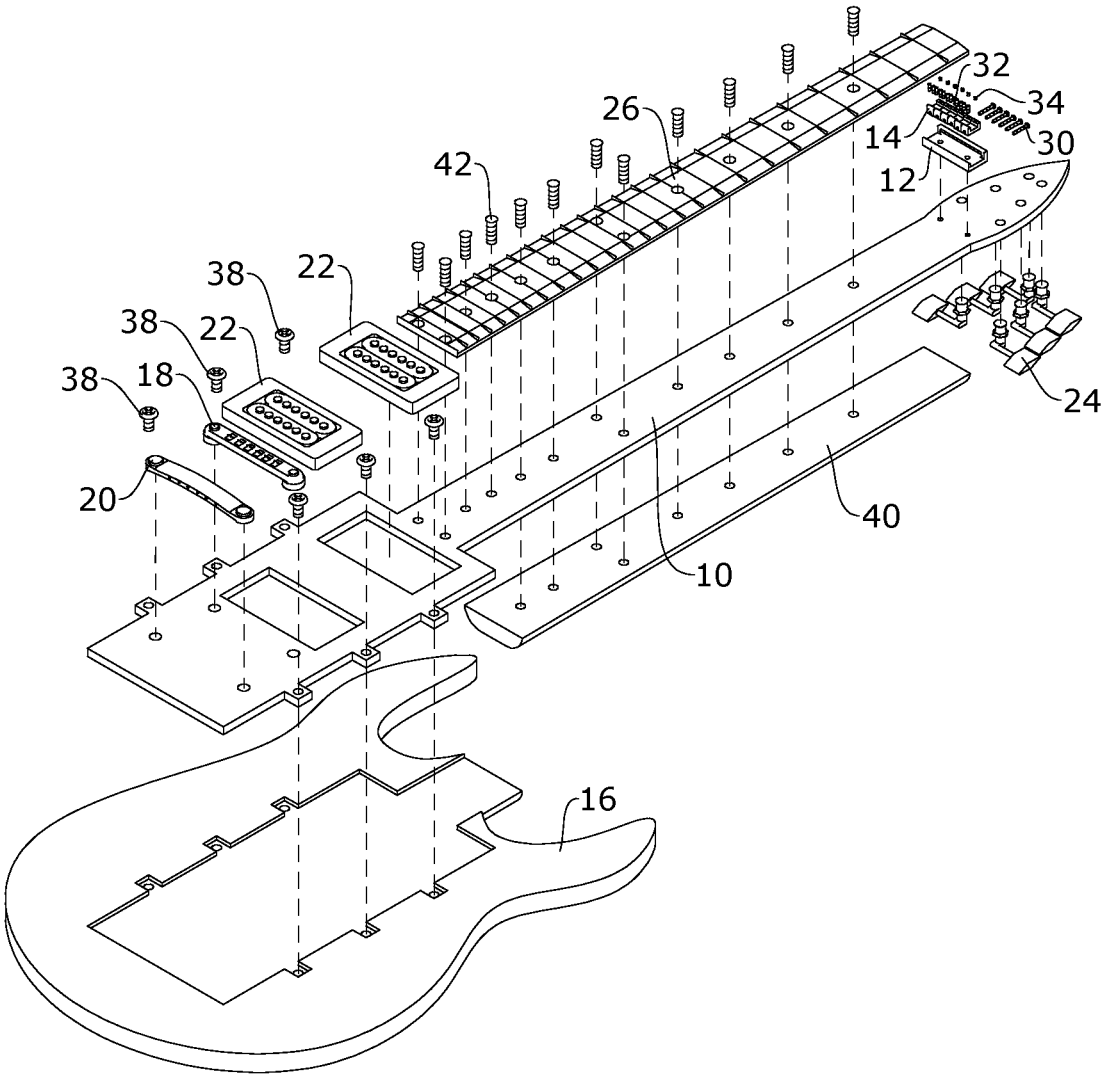
FIG. 3 is an exploded view of the embodiment of the present invention.
Figure 4:
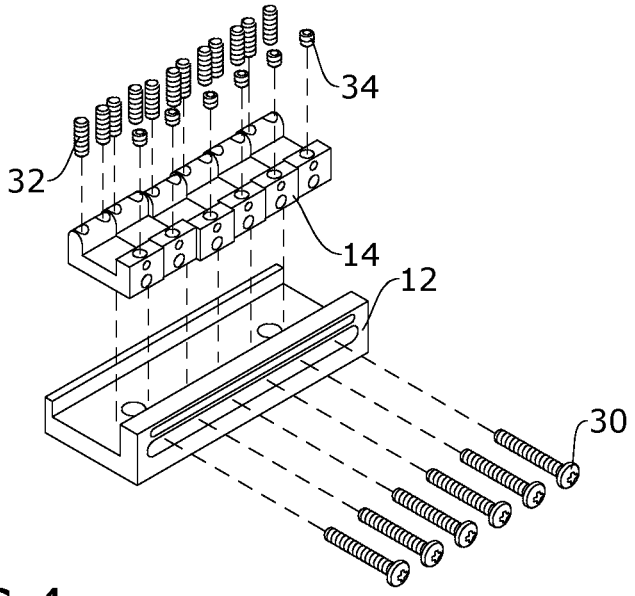
FIG. 4 is a detailed exploded view of the embodiment of the present invention, showing a moveable nut of the present invention.

Referring now to FIGS. 1-9, embodiments of the present invention comprise a base plate 10 (which may be formed from metal) drilled with a plurality of threaded holes (see FIG. 3). Referring to FIG. 3, from left to right, the base plate 10 generally includes a main body portion (the wider portion that overlays the guitar body 16, in use), an elongated portion (the thin section that connects to the fretboard 26, among other parts), and an end portion (the curved terminal section that couples with the tuners 24). The base plate 10 forms the core backbone of the instrument, obviating the need to use a stiffening or straightness adjusting device ("truss rod") to be built in, as is, in the neck 40 of conventional instruments. The drilled threaded holes are provided so that suitably engineered and drilled guitar bodies 16, bridges 18, tailpieces 20, pickups 22, necks 40, tuners 24, and fretboards 26, 28 (with fretboard 28 being a custom fretboard in accordance with the present invention) can be mounted on top (e.g., bridges 18, tailpieces 20, pickups 22, and fretboards 26, 28), under (e.g., guitar bodies 16, necks 40), and through (tuners 24) to modify the core elements of the guitar. As shown in FIG. 3, base plate screws 38 may be used to fasten various elements to the base plate.

Cavities (rectangular shaped ones disposed proximal the guitar body 16), are cut out in the base plate 10 (in the main body portion) to be able to accept the type, and number of pickups 22 required to be accommodated in any particular embodiment, allowing the player to customize the instrument further to his/her liking. Further, special mounting holes are provided to install a moveable guitar nut plate 12 and adjustable saddles (this term is used interchangeably with nut blocks 14) for each string 36, further described below.

It will be appreciated that cavities for electronic accessories (e.g., tone controls, volume controls, pickup selectors) and onboard micro-electronics (e.g., MIDI processors, effects processers, preamplifiers, microcomputers) are assumed to be provided in the guitar body 16 and connected to the pickups 22, as per current practice and commercial products available in the field of the present invention.

Some of the previously mentioned holes are disposed in an elongated section of the base plate 10, are designed to align with holes tapped in the fretboard 26 and the neck 40 and receive fret screws 42. This allows these components to be tailored to the requirements of the individual player, and, in particular, the fretboard 26, where the spacing of the frets is precisely calculated with a computer algorithm that utilizes the unique features of the guitar's construction (e.g., moveable bridge 18 and individual string nut blocks 14), to design a more accurately playing instrument, of the desired temperament and/or key. The replaceable neck 40 is designed to allow players to customize the neck profile and finish to their specific playing requirements. Advantageously, replacement of these items can be accomplished even with the strings 36 at full tension on the instrument, with just an ordinaryscrewdriver.

The base plate 10 of the present invention is configured to allow for a 2 Humbucking pickupconfiguration, and a Les Paul style adjustable bridge. The base plate 10, as shown, is configured for a guitar designed to have 24 frets and be of a scale length (bridge to nut) of 28.8". The present invention envisages the design and manufacture of multiple kinds of base plates 10 (and associated necks/fretboards) in scale lengths and configurations to meet the requirements of multiple guitar types, small to bass/baritone guitar scales, different pickup, fretboard, and neck requirements. Consequently, it will be appreciated that such appropriate modifications to result in different configurations of base plate are within the spirit and scope of the present disclosure.

A key feature of the base plate 10 is to provide a solid geometrically accurate foundation on which the adjustable bridges 18 and nut plates 12/nut blocks 14 are mounted, providing a great deal of flexibility in precisely positioning the vibrating string 36 with respect to the frets along the fretboard 26, allowing for custom height, slopes, and lengths for each string 36 to accommodate fretboard 26 temperament and player feel requirements. This is facilitated by the moveable nut (comprised of a nut plate 12 and nut block 14) depicted in FIGS. 4-8.

Figure 5:
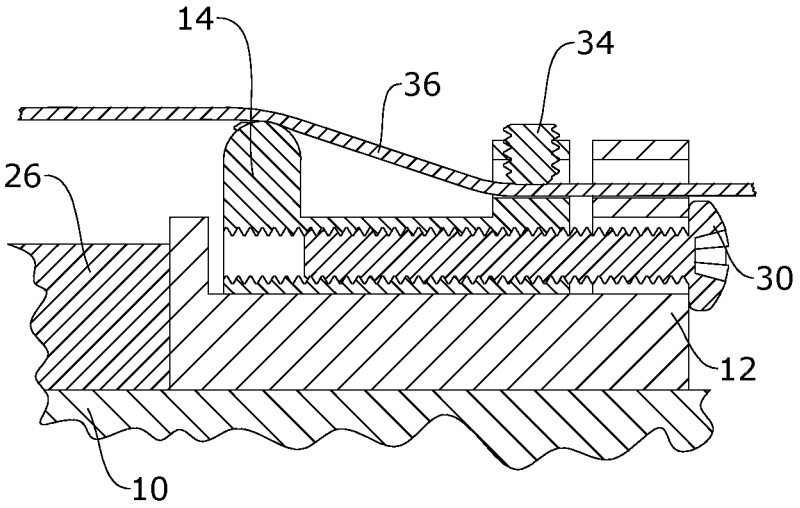
FIG. 5 is a detailed section view of the embodiment of the present invention, taken along line 6-6 in FIG. 1 and showing a nut block in an intermediate position.
Figure 6:
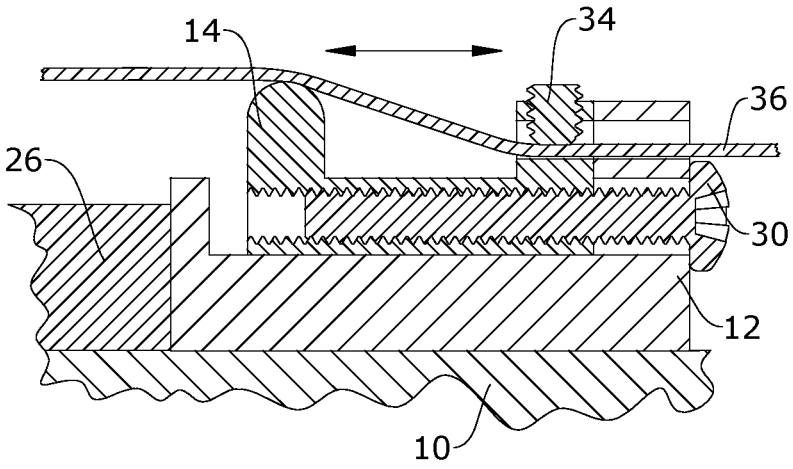
FIG. 6 is a detailed section view of the embodiment of the present invention, similar to FIG. 5 and showing the nut block adjusted to a distal position.

FIGS. 4-8 shows the location, and detailed construction of the first component of the moveable nut, the nut plate 12. In certain embodiments, this is a metallic component, anchored to the metal base plate 10 with two screws. The nut plate 12 is designed to accommodate multiple individual nut blocks 14, with one for each string, as shown in FIGS. 5-6. Each of these nut blocks' distance from the bridge 18 is adjustable by a screw 30 that substantially runs the length of the nut block 14 through holes drilled in the nut block 14 to accept them, as shown in FIGS. 5-6. As can be seen, the screw 30 is threaded with the nut block 14 such that rotation of the screw 30 in a first direction results in the nut block 14 moving away from the bridge 18 or towards the bridge 18 when the screw 30 is rotated in a second direction. This, in turn, adjusts the location of an upper string contact point of the nut block 14 with the string 36. String tension is sufficient to keep the blocks 14 anchored to a location, and the use of a small biasing spring is also another possibility in other embodiments. In such embodiments, the spring may be placed between the nut block 14, concentric to the screw 30, and terminating before the rear upright wall of the nut plate 12.

Figure 7:
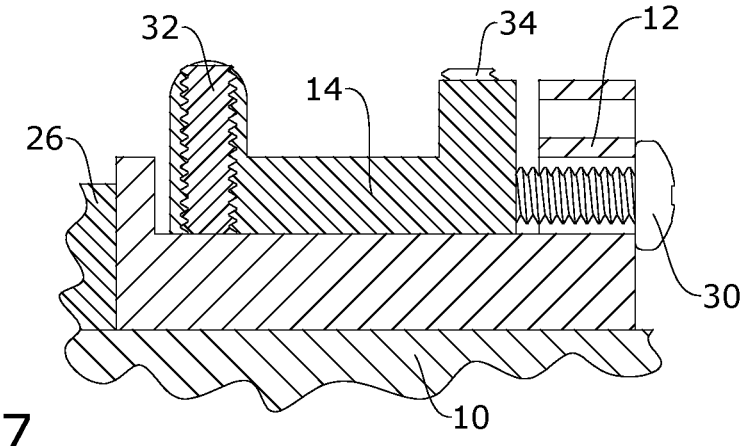
FIG. 7 is a detailed section view of the embodiment of the present invention, taken along line 8-8 in FIG. 2.
Figure 8:
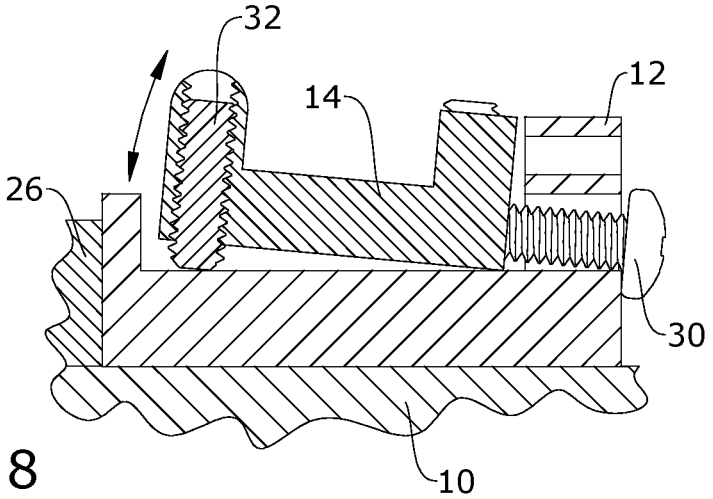
FIG. 8 is a detailed section view of the embodiment of the present invention, showing the nut block adjusted vertically on a proximal end.
Figure 9:
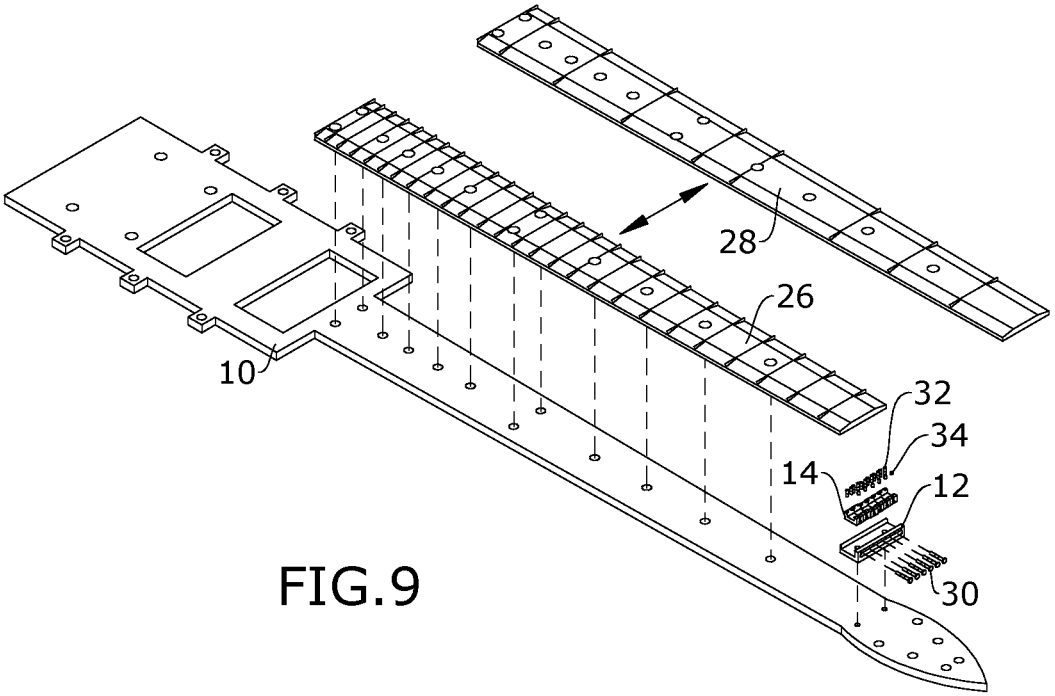
FIG. 9 is a detailed exploded view of the embodiment of the present invention, showing an alternative configuration of a fretboard.

Strings 36 from the bridge pass over the nut block 14, the height of which is adjustable by two nut block adjustment screws 32 drilled vertically near the upper string contact point. This height adjustment (which serves to raise and lower the string 36 relative to the base plate 10) is achieved by rotating the screws 32 to selectively incline the nut block, as shown in FIGS. 7-8. In certain embodiments, the string then passes over another hole, drilled to accept a screw that locks a nut cover plate over the string 36 to securely lock the string tension. This mechanism is intended to supplement the action of commercially available string locking tuners and is a common feature of locking nuts that are also commercially available on the market. FIGS. 4-8 illustrate an embodiment of the nut saddle 14 that incorporates curved string contact points to maximize note sustain, by minimizing string to nut friction. In this embodiment, the string rest on an upper spring contact point on a proximal end thereof and extend through a hole in the nut block 14 at a distal end thereof, with a string screw 34 holding the string in place.

Another component of the present invention is a software program that, given a desired tuning key and temperament, string action (height above the frets)—computes expected pitch deviations from string displacement/tension changes due to player fretting action. These pitch deviations are considered when computing optimal string length, nut, bridge, and fret location adjustments on a conventional (parallel frets) fretboard 26 of a given scale length. The fretboard is manufactured to these specifications with conventional methods, and finally, drilled so to be able to be installed onto the metal base.

The program algorithm follows the below described process steps:

1. Initialize with data: String thickness, mass per unit length, scale length desired, height of each string above the fret (string action), degree to which string is pressed down by player at each fret (string displacement), and the desired pitches (key/temperament).
2. Compute open string (unstressed by fretting) tension required to generate the lowest note for all strings.
3. For each string, calculate theoretically ideal fret positions (for the given temperament), and modify them as required to generate the desired pitch, based on neutralizing pitch deviations caused by player fretting.
4. Designate the $3^{rd}$ fret as the base fret, and align $3^{rd}$ fret positions to the same value for all strings (position the string so that the $3^{rd}$ frets are aligned).
   a. At this point, all the strings have fret positions for the third fret individually calculated, which will not exactly align with any other strings calculated $3^{rd}$ fret position. In Step 4, the strings are "aligned" so that all their $3^{rd}$ frets are placed at the same distance from the nut, the strings themselves shifted forward or backward to align at that position. Picking a string for that aligned distance . . . or an average $3^{rd}$ fret distance computed across all strings can be the starting point here. Now all the other strings $14^{th}$ fret positions can be inspected for deviations from alignment, which is step 5.
5. At the $14^{th}$ fret, identify pitch/fret location deviations, and compute a new scale length for the string such that the deviation in fret positions at the $14^{th}$ across all strings are minimized.
6. Recompute fret locations from step 2, and iterate steps 2 through 6, until the solution converges to a final set of fret locations for all strings, and bridge and nut adjustments for each individual string are determined.

This method for calculating string and nut adjustments leverages the invention's capability to individually adjust each string with a high degree of precision, to achieve very precise results for pitch and temperament correctness. If this degree of precision is not required, a more accurately playing instrument can also be accomplished by any beginner, with a conventional fretboard (constructed with frets for standard even temperament) installed (drilled to be mounted on the baseas indicated), as below.

The player first sets open string tension by tightening each string to pitch and ensures that open notes are tuned correctly. Next, the bridge position is adjusted per normal intonating procedure to even out pitch errors between open and $12^{th}$ fret octave notes. Lastly, the open string pitch, and pitch at the first fret are compared with desired values, and the nut saddle adjusted towards the bridge or away from it as desired to solve the "first fret" problem. The process is repeated and iterated on all strings till the instrument is perfectly in tune in the playing position, and the strings can now be locked down, and fine-tuned with fine tuning adjusters available on most commercial bridges.

The above process needs to be done just once, for a specific set of strings. Once the nut adjustments are complete, replacing strings with the same gauge does not require the instrument to be re-intonated or the nut saddles to be adjusted. Changes in player, string gauge, and string action will necessitate a re-calibration, and if desired, an alternative fretboard installation for the new player.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Further appropriate methods of making and using embodiments of the present invention would be readily apparent to those with skill in the art from the foregoing disclosure. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

The computer-based program product and method described above is for purposes of example only, and may be implemented in any type of computer system or programming or processing environment, or in a computer program, alone or in conjunction with hardware. The present invention may also be implemented in software stored on a computer-readable medium and executed as a computer program on a general purpose or special purpose computer. For clarity, only those aspects of the system germane to the invention are described, and product details well known in the art are omitted. For the same reason, the computer hardware is not described in further detail. It should thus be understood that the invention is not limited to any specific computer language, program, or computer. It is further contemplated that the present invention may be run on a stand-alone computer system, or may be run from a server computer system that can be accessed by a plurality of client computer systems interconnected over an intranet network, or that is accessible to clients over the Internet. In addition, many embodiments of the present invention have application to a wide range of industries. To the extent the present application discloses a system, the method implemented by that system, as well as software stored on a computer-readable medium and executed as a computer program to perform the method on a general purpose or special purpose computer, are within the scope of the present invention. Further, to the extent the present application discloses a method, a system of apparatuses configured to implement the method are within the scope of the present invention.

What is claimed is:

1. A guitar assembly comprising:
a guitar body;
a fretboard;
a plurality of guitar string tuners;
a plurality of guitar strings;
a substantially flat, metal guitar base plate comprising:
a main body portion including a first set of holes and coupled to the guitar body;

an elongated portion integral with the main body portion, including a second set of holes, and coupled to the fretboard; and an end portion integral with the elongated portion, including a third set of holes, and coupled to the plurality of guitar string tuners; and a moveable nut for adjusting guitar string scale length of the plurality of guitar strings, the moveable nut comprising:

a nut plate coupled to the end portion of the base plate; and a plurality of nut blocks moveably coupled to the nut plate, with each nut block engaging a respective guitar string of the plurality of guitar strings, the plurality of nut blocks being separately adjustable relative to one another.

2. The guitar assembly of claim 1, wherein each of the plurality of nut blocks are adjustable in a horizontal direction.

3. The guitar assembly of claim 1, wherein each of the plurality of nut blocks are adjustable in a vertical direction on at least one end thereof.

* * * * *